United States Patent [19]

Armstrong

[11] Patent Number: 4,511,139

[45] Date of Patent: Apr. 16, 1985

[54] BASEBALL TRAINING BAT

[76] Inventor: Harold A. Armstrong, 3919 Ladoga, Long Beach, Calif. 90808

[21] Appl. No.: 579,271

[22] Filed: Feb. 13, 1984

[51] Int. Cl.[3] ..... A63B 69/40

[52] U.S. Cl. ..... 273/26 B

[58] Field of Search ..... 273/26 R, 26 B, 29 A, 273/72 R, 67, 186 A, 193 B, 627; 446/418, 421

[56] References Cited

U.S. PATENT DOCUMENTS

| | | | |
|---|---|---|---|
| 1,428,015 | 9/1922 | Dienner | 273/77 |
| 1,616,377 | 2/1927 | Knight | 273/77 |
| 2,158,211 | 5/1939 | Aitken | 273/35 |
| 2,159,579 | 5/1939 | Whitney | 273/77 |
| 2,497,237 | 2/1950 | Reineking | 273/80 |
| 3,136,546 | 6/1964 | Conolly | 446/421 |
| 3,170,690 | 2/1965 | Goranson et al. | 273/77 |
| 3,173,688 | 3/1965 | Green | 446/418 |
| 3,606,340 | 9/1971 | Tiller | 273/186 A |
| 3,679,205 | 7/1972 | Finkle et al. | 273/29 A |
| 3,783,733 | 1/1974 | Zirimis | 446/421 |
| 4,367,871 | 1/1983 | Schiefer | 273/29 A |

*Primary Examiner*—Richard C. Pinkham
*Assistant Examiner*—T. Brown
*Attorney, Agent, or Firm*—Fulwider, Patton, Rieber, Lee & Utecht

[57] ABSTRACT

A baseball training bat for use in teaching a baseball player to snap his wrist when swinging at a baseball. The bat is sawn through at its intermediate portion, and the two parts thereof are hingedly connected together at the rear portion of the bat. If the baseball player snaps his wrists while swinging the bat, the top segment of the bat will rapidly rotate towards the lower portion of the bat so as to strike such lower portion with an audible noise.

2 Claims, 6 Drawing Figures

BASEBALL TRAINING BAT

BACKGROUND OF THE INVENTION

It is difficult to teach baseball players, and particularly younger players such as those enrolled in Little League groups, to snap the wrist when swinging at a ball. The natural tendency of a player is to drag the bat through its swing. As a result, the player applies insufficient power to the ball.

SUMMARY OF THE INVENTION

It is a major object of the present invention to provide a baseball training bat which will teach a player to use proper wrist action when swinging at a ball.

Another object of the present invention is to provide a baseball training bat which may be easily fabricated from a conventional baseball bat at a low cost of manufacture.

A more particular object of the present invention is to provide a baseball training bat of conventional configuration having a handle and a tip, with such bat being cut at approximately the mid-portion of the ball-contacting segment of the bat to define a discontinuity through the bat. A hinge interconnects the two parts of the bat at the rear of the bat body. When the bat is swung n a ball-hitting motion, the top segment of the bat will strike the lower portion thereof with an audible noise to indicate the ball player has employed adequate wrist action. If adequate wrist action is not employed, the top portion of the bat will trail the lower portion thereof.

A further object of the present invention is to provide a baseball training bat of the aforedescribed nature which includes a safety line connecting the two parts of the bat.

These and other objects and advantages of the present invention will become apparent from the following detailed description.

DETAILED DESCRIPTION OF A PREFERRED EMBODIMENT

Figure 1:
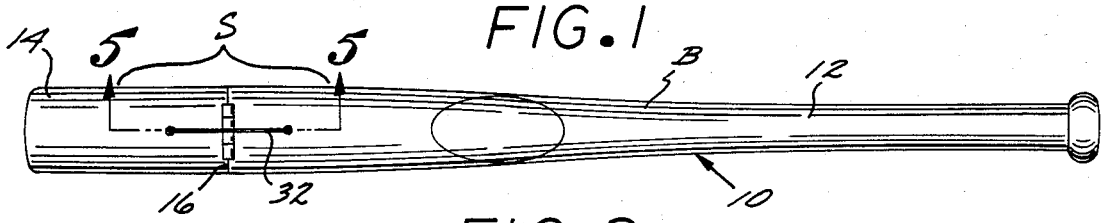
FIG. 1 is a rear elevational view of a baseball training bat embodying the present invention.
Figure 2:
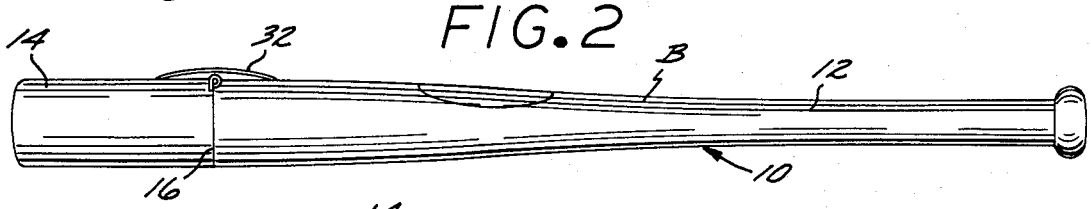
FIG. 2 is a side elevational view of said bat.
Figure 3:
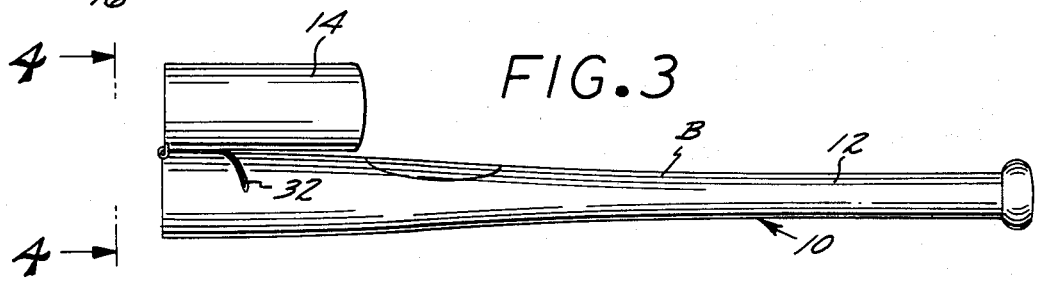
FIG. 3 is a side elevational view of said bat showing the hinged interconnection between the two parts of such bat.

Referring to the drawings, there is shown a preferred form of baseball training bat B embodying the present invention. Such bat is of conventional construction, and includes a body, generally designated 10, having a handle portion 12 and a tip portion 14. The intermediate portion of the body 12 between the top of the bat and the upper part of the handle portion 12 constitutes the optimum ball-contacting segment S of the bat body 12. The bat body 12 is sawn or otherwise formed with a transverse cut at approximately the mid-portion of the ball-contacting segment S to define a discontinuity 16 through the bat body.

Figure 4:
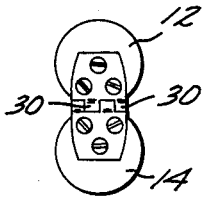
FIG. 4 is a vertical view taken along line 4—4 of FIG. 3.
Figure 5:
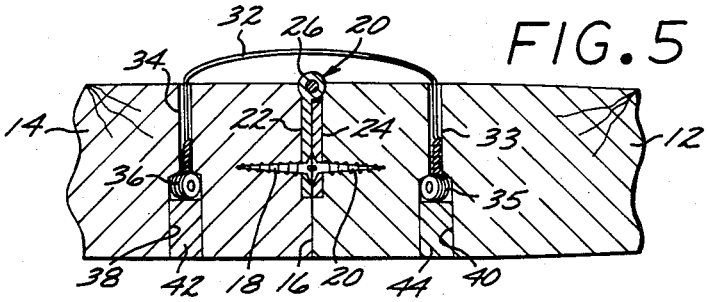
FIG. 5 is a horizontal sectional view taken in enlarged scale along line 5—5 of FIG. 1.

A conventional hinge, generally designated 20, interconnects the two sides of the discontinuity 16 at the rear of the bat body. Hinge 20 includes front and rear plate elements 22 and 24, respectively, which are pivotally interconnected by a horizontally extending pivot pin 26. The plates 22 and 24 are secured to the tip and handle portions 14 and 16 by screws 18 and 20, as shown particularly in FIGS. 4 and 5. As indicated in FIG. 4, the adjoining edges of plates 22 and 24 are formed with complementary ears 30 which receive the hinge pin 26.

The tip portion 14 is also connected to the handle portion 16 by means of a safety line such as a cable 32. The cable extends into bores 33 and 34. The top of the cable 32 is rigidly affixed to anchor elements such as washers 35 and 36, which are received within the inner ends of cavities 38 and 40 formed in the tip and handle portions 14 and 16, as shown particularly in FIG. 5. With continued reference to FIG. 5, cavities 38 and 40 are closed by suitable plugs 42 and 44 respectively.

Figure 6:
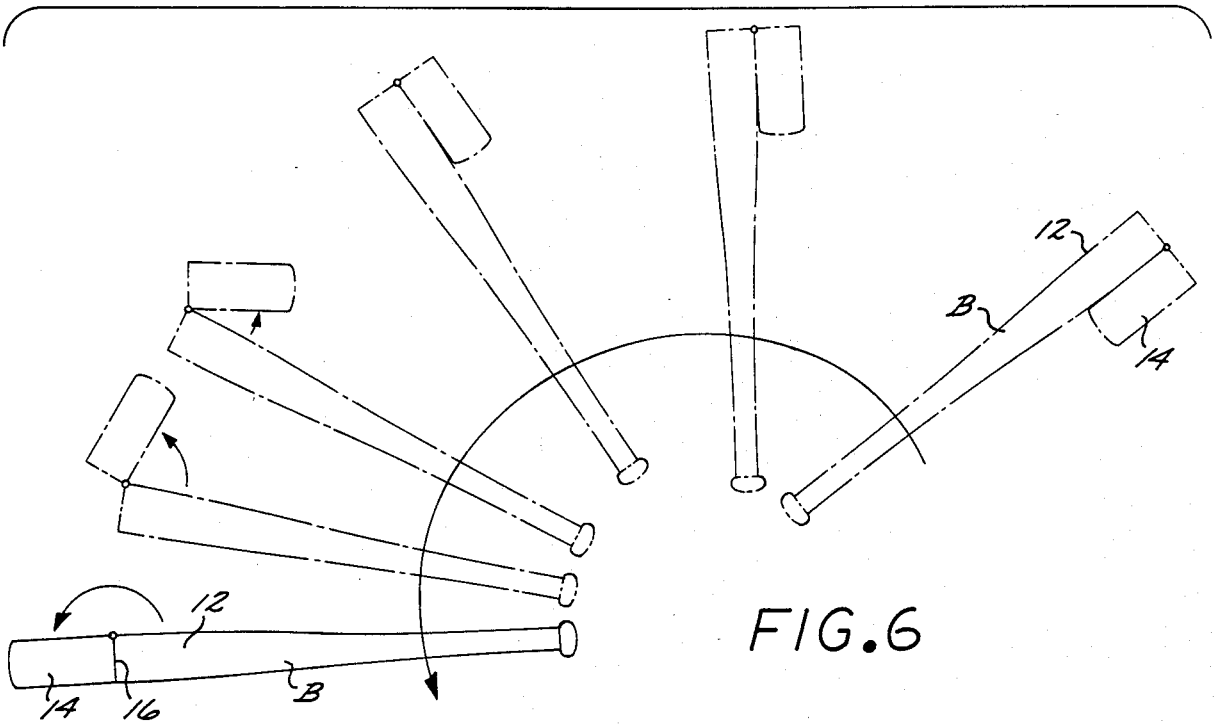
FIG. 6 is a diagrametric view showing the operation of said baseball training bat.

Referring to FIG. 6, the operation of the aforedescribed baseball training bat B is shown. FIG. 6 is taken from a point above a player as such player swings the baseball training bat in a counterclockwise direction, as indicated by the directional arrow. At the beginning of the swing, the tip portion 14 will be in its rearwardly pivoted position. As the baseball player continues his swing, assuming he applies a proper snapping action of his wrists, the tip portion 14 will rapidly rotate in a counterclockwise direction towards the upper part of the handle section 16 until the bottom surface of the tip portion 14 strikes the top surface of the handle portion 16 with an audible noise. If, on the other hand, the player merely pushes the bat during a ball swinging motion, the tip portion 14 will trail the handle portion 16 and will not strike the handle portion.

It has been determined that by utilizing the aforedescribed baseball training bat, a baseball player will quickly learn to apply a proper wrist snapping action. It should be noted tha the baseball training bat should not be employed to actually strike a baseball. It should also be noted that the provision of the safetly line 32 insures that the tip portion 14 will not fly-off the handle portion 16 should the hinge 20 fail.

Various modifications and changes may be made with respect to the aforegoing description without departing from the spirit of the present invention.

I claim:

1. A baseball training bat comprising an elongated bat body of conventional shape having a handle portion and a ball contacting portion disposed remote from said handle portion, said ball contacting portion being divided into a free end section and a handle section, said sections being joined by a hinge means for pivotal movement relative to one another, such that one end of said free end section will pivot into alignment with one end of said handle section to make contact with said handle section and emit an audible sound when said bat is swung by a user.

2. The baseball bat of claim 1 further comprising a safety line having one of its ends attached to said end section on one side of said hinge and its other end attached to said handle section on the other side of said hinge.

* * * * *